US005794630A

United States Patent [19]

Mengoli et al.

[11] Patent Number: 5,794,630

[45] Date of Patent: Aug. 18, 1998

[54] UNIT FOR SIMULTANEOUSLY FORMING TWO LAYERS OF TOBACCO

[75] Inventors: Fausto Mengoli, Sasso Marconi; Fiorenzo Draghetti, Medicina, both of Italy

[73] Assignee: G.D Societa' Per Azioni, Bologna, Italy

[21] Appl. No.: 802,897

[22] Filed: Feb. 18, 1997

[30] Foreign Application Priority Data

Feb. 19, 1996 [IT] Italy ..... BO96A0072

[51] Int. Cl.[6] ..... A24C 5/18

[52] U.S. Cl. ..... 131/84.1; 131/84.2; 131/84.3

[58] Field of Search ..... 131/84.1, 84.2, 131/84.3, 84.4

[56] References Cited

U.S. PATENT DOCUMENTS 5,582,191 12/1996 Sartoni et al. ..... 131/84.1

FOREIGN PATENT DOCUMENTS

19518179 A 11/1995 Germany ..... 131/84.1
19524886 A 1/1996 Germany ..... 131/84.1
2269975 2/1994 United Kingdom ..... 131/84.1

*Primary Examiner*—Aaron J. Lewis
*Assistant Examiner*—Charles W. Anderson
*Attorney, Agent, or Firm*—Marshall, O'Toole, Gerstein, Murray & Borun

[57] ABSTRACT

A unit for forming two layers of tobacco, wherein a stream of shredded tobacco fed in a given direction is intercepted by two side by side dividing devices, each having a suction conveyor belt, one branch of which travels crosswise to a respective portion of the stream to form a respective layer; and both the layers of tobacco are fed by the respective dividing devices to a transfer station where each of the two layers is transferred continuously onto the underside of a respective suction belt for supply to a cigarette rod forming beam.

8 Claims, 2 Drawing Sheets

UNIT FOR SIMULTANEOUSLY FORMING TWO LAYERS OF TOBACCO

BACKGROUND OF THE INVENTION

The present invention relates to a unit for simultaneously forming two layers of tobacco.

More specifically, the present invention relates to a unit for simultaneously forming two layers of tobacco from which to simultaneously form two continuous cigarette rods.

Dual-rod cigarette manufacturing machines are known to feature a unit for forming layers of tobacco, and by which a stream of shredded tobacco is fed to the bottom end of an upflow conduit closed at the top by two side by side suction belts. The stream of tobacco is then blown up the conduit and divided in various ways into equal parts, which settle on the respective suction belts to form respective layers of tobacco, which are fed by the belts onto respective strips of paper moving along a rod forming beam.

Machines employing the above solution involve several drawbacks, due to the upflow conduit normally determining the overall geometry of the machine, which is not always satisfactory in terms of machine maintenance and safety.

SUMMARY OF THE INVENTION

It is an object of the present invention to provide a straightforward, relatively low-cost unit for simultaneously forming two layers of tobacco without using a dividing upflow conduit.

According to the present invention, there is provided a unit for simultaneously forming two layers of tobacco, the unit comprising a conveying device for feeding a stream of shredded tobacco in a given direction; and dividing conveying means for concentrating said stream into two layers, and comprising two suction conveyor belts, each in turn comprising an intercepting branch movable crosswise to a respective portion of said stream, and a conveying branch movable substantially in said direction; characterized by also comprising, for each said conveyor belt, a suction belt, and a transfer station through which travel at least part of the conveying branch of each conveyor belt and at least part of the respective suction belt; each conveying branch extending beneath the respective suction belt at the transfer station.

According to a preferred embodiment of the above unit, the two intercepting branches converge, and the two conveying branches are located side by side and extend in said direction.

The above unit also preferably comprises a dividing element located between said intercepting branches to divide said stream longitudinally into two substreams; the two intercepting branches converging towards each other in said direction and towards said dividing element, so as each to intercept a respective said substream.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
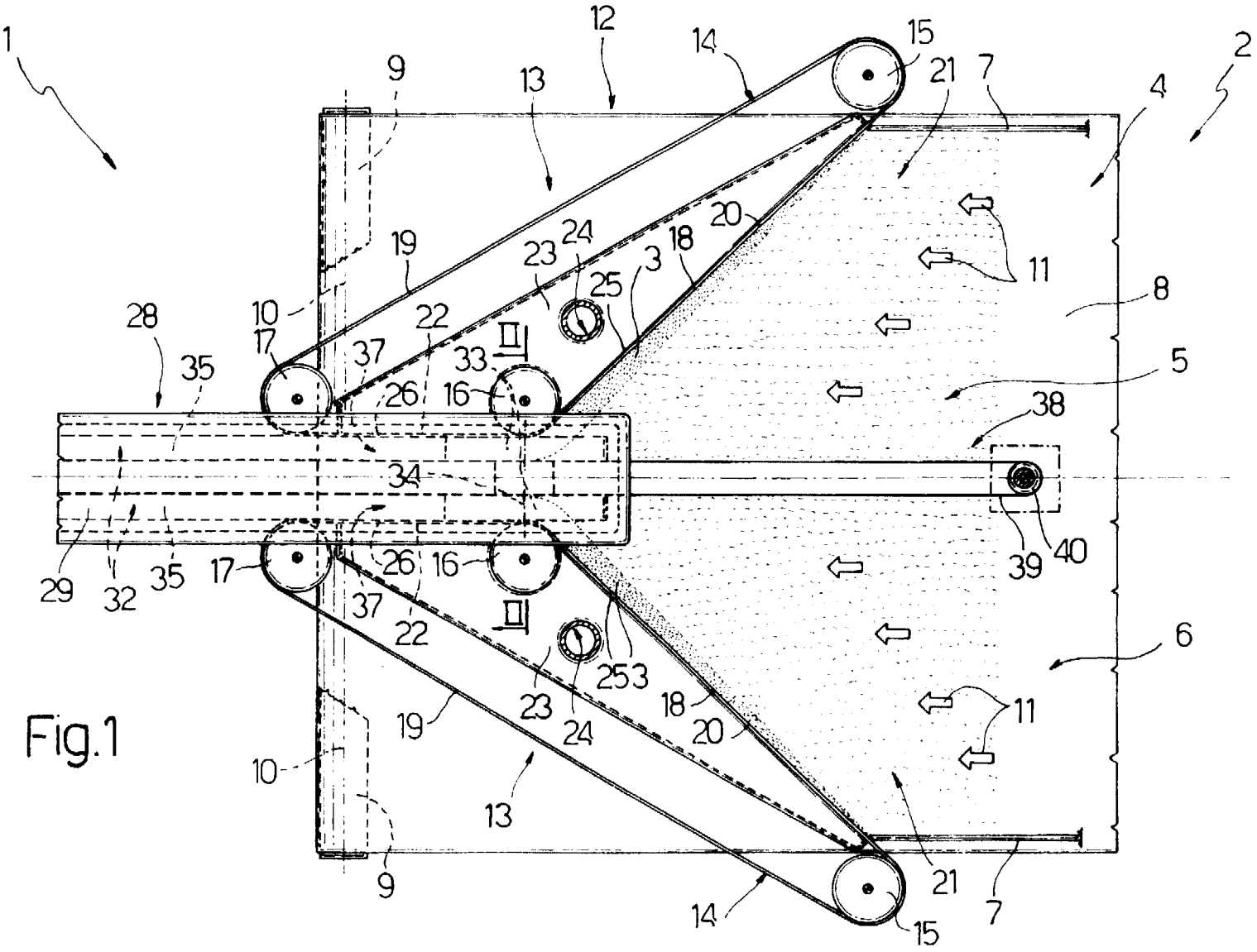
FIG. 1 shows a schematic plan view of a preferred embodiment of the unit according to the present invention.

Number 1 in FIG. 1 indicates a dual-rod cigarette manufacturing machine featuring a unit 2 for simultaneously forming two continuous layers 3 of tobacco.

Unit 2 comprises a conveyor 4 for feeding a stream 5 of shredded tobacco along a substantially horizontal surface 6 defined laterally by two parallel vertical sides 7. Conveyor 4 comprises a conveyor belt 8 looped about two pulleys 9 (only one shown) mounted for rotation about respective axes 10 perpendicular to sides 7, and which feeds tobacco stream 5, in a substantially horizontal direction 11 parallel to sides 7, to a dividing conveyor assembly 12 for forming layers 3.

According to a variation not shown, surface 6 is defined by the bottom wall of a substantially horizontal conduit along which tobacco stream 5 is blown in direction 11 to assembly 12. In which case, conveyor 4 also comprises a top wall over and parallel to surface 6.

Assembly 12 comprises two dividing devices 13 located symmetrically with respect to the longitudinal axis of belt 8, and each comprising a conveyor belt 14 made of material permeable to air, and which travels at constant speed and is looped about three pulleys 15, 16, 17 mounted for rotation about respective axes perpendicular to surface 6. Pulleys 15 and 17 are transmission pulleys, and define, on each conveyor belt 14, a transportation branch 18 facing the other device 13, and a return branch 19. Branch 18 comprises an intercepting branch 20 extending between pulleys 15 and 16, crosswise to direction 11, and across a respective half of belt 8 to intercept a respective half of stream 5 hereinafter referred to as substream 21; and a conveying branch 22.traveling at the same speed as belt 8 and extending parallel to direction 11 between pulleys 16 and 17. The intercepting branches 20 of the two devices 13 converge with each other.

With reference to FIG. 1, each device 13 also comprises a suction chamber 23 extending along the whole of branch 18 and comprising a conduit 24 communicating with a known suction device (not shown). Each chamber 23 comprises two perforated lateral walls 25 and 26 respectively adjacent to branches 20 and 22 of respective conveyor belt 14, and which provide for retaining respective substream 21 on branches 20 and 22 to form respective tobacco layer 3.

Unit 2 also comprises a conveying device 28 for transferring the two layers 3 of tobacco to a known device (not shown) for forming two continuous cigarette rods (not shown). Device 28 comprises a substantially parallelepiped suction chamber 29, in turn having a longitudinal axis extending parallel to the longitudinal axis of belt 8, and a bottom wall 30 parallel to surface 6. Wall 30 comprises two longitudinal openings 31 extending parallel to the longitudinal axis of chamber 29 and along the whole length of wall 30; an end portion of wall 30 is located substantially contacting surface 6; and openings 31 are located symmetrically on either side of the longitudinal axis of belt 8, and are each engaged in sliding manner by a respective conveying branch 22.

Figure 2:
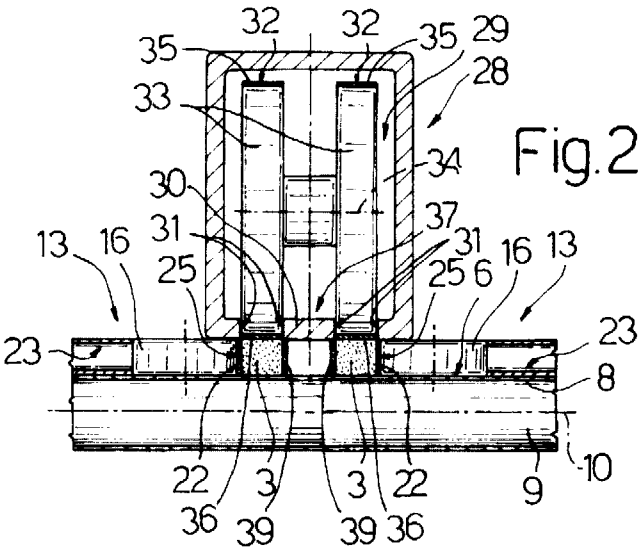
FIG. 2 shows a section along line II—II in FIG. 1.

With reference to FIG. 2, inside chamber 29, device 28 also comprises two belts 32 permeable to air and looped about the same pair of double pulleys 33 (only one shown), which are housed inside chamber 29 and mounted for rotation about respective horizontal axes 34 perpendicular to the traveling direction 11 of layers 3. Pulleys 33 are end transmission pulleys, and define, on each belt 32, a top branch 35 housed inside chamber 29, and a bottom branch 36 traveling parallel to surface 6 in direction 11 at the same speed as belt 8, and engaging in sliding manner a respective opening 31. An input portion of each branch 36 is located perpendicular to, and substantially contacting, respective conveying branch 22, and defines, with branch 22, a transfer station 37 inside which the layer 3 on each branch 22 is transferred to branch 36 of respective belt 32.

As shown in FIG. 1, unit 2 preferably, but not necessarily, comprises a dividing element 38 located between the two intercepting branches 20 and aligned with device 28 to divide stream 5 longitudinally into two substreams 21. Dividing element 38 comprises a parting belt 39 fixed over, and substantially contacting, surface 6, and looped about two pulleys 40 (only one shown in FIG. 1) coaxial with respective axes perpendicular to surface 6.

Figure 4:
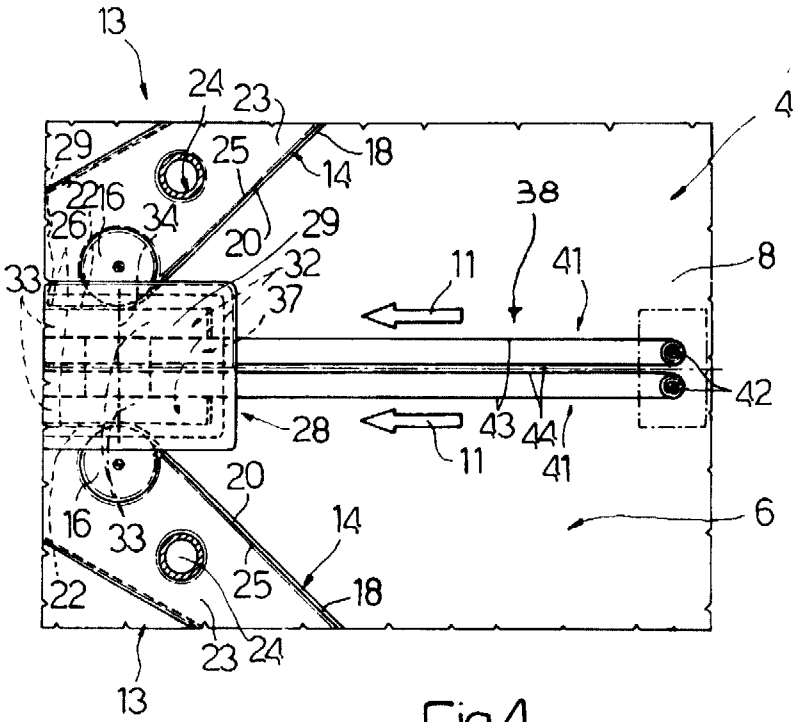
FIG. 4 shows a plan view of a variation of a second detail of the FIG. 1 unit.

In the FIG. 4 variation, as opposed to parting belt 39, dividing element 38 comprises two movable belts 41 located over surface 6 and looped about respective pairs of pulleys 42 mounted for rotation about respective axes perpendicular to surface 6. Each pair of pulleys 42 defines, on respective belt 41, an outer branch 43 and an inner branch 44, both parallel to the traveling direction 11 of stream 5. Branches 44 are located facing each other, and move in the opposite direction to direction 11, while each branch 43 faces a respective device 13, and moves in direction 11 at the same speed as stream 5.

Figure 3:
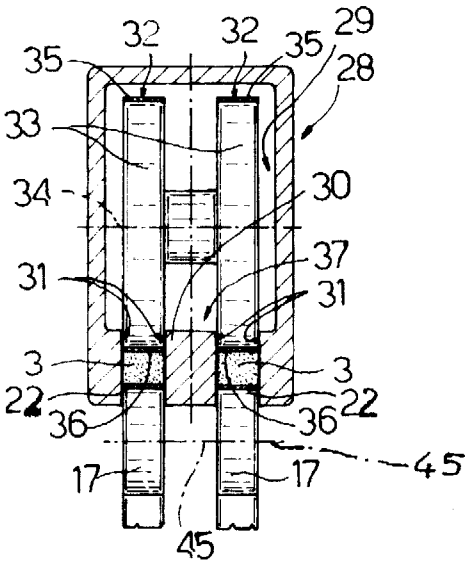
FIG. 3 is similar to FIG. 2, and shows a section, with parts removed for clarity, of a variation of a first detail of the FIG. 1 unit.

In the FIG. 3 variation, along respective branch 22, conveyor belt 14 of each device 13 is twisted 90° to face bottom branch 36 of corresponding belt 32 at transfer station 37. As shown in FIG. 3, the two end pulleys 17 of the two conveyor belts 14 are located side by side, each beneath corresponding belt 32, and are mounted for rotation about the same horizontal axis 45 parallel to axis 34.

In actual use, tobacco stream 5 is fed at constant speed in direction 11 by belt 8, and is divided, possibly with the aid of element 38, into two substreams 21, each of which is intercepted by branch 20 of respective conveyor belt 14 to form, by gradual accumulation on branch 20, a layer 3 of tobacco which is supplied to transfer station 37. At station 37, branch 22 of each conveyor belt 14 continuously transfers the respective layer 3 of tobacco to branch 36 of respective belt 32 traveling over branch 22 in direction 11; and, finally, branches 36 of the two belts 32 feed respective layers 3 of tobacco to said device (not shown) for forming two continuous cigarette rods (not shown).

We claim:

1. A unit (2) for simultaneously forming two layers (3) of tobacco, the unit (2) comprising a conveying device (4) for feeding a stream (5) of shredded tobacco in a given direction (11); and dividing conveying means (12) for concentrating said stream (5) into two layers (3); said dividing conveying means (12) comprising two suction conveyors (14), each in turn comprising an intercepting branch (20) movable crosswise to a respective portion (21) of said stream (5), and a conveying branch (22) movable substantially in said g n direction (11); a transfer station (37) through which at least part of the conveying branch (22) of each suction conveyor (14) extends; and, for each said conveying branch (22), a suction belt (32) at least part of which extends in said given direction (11) above and along the respective conveying branch (22) at said transfer station (37) to receive a respective said layer (3) of tobacco from the respective conveying branch (22).

2. A unit as claimed in claim 1, wherein the two intercepting branches (20) converge, and the two conveying branches (22) extend in said given direction (11).

3. A unit as claimed in claim 1, wherein said unit (2) also includes a dividing element (38) located between said intercepting branches (20) to divide said stream (5) longitudinally into two substreams (21); the two intercepting branches (20) converging towards each other in said given direction (11) and towards said dividing element (38), so as each to intercept a respective said substream (21).

4. A unit as claimed in claim 3, wherein said conveying device (4) defines a surface (6) for conveying said stream (5) of tobacco; said dividing element (38) comprising two belt conveyors (41) traveling in opposite directions parallel to said given direction (11) and located over said surface (6).

5. A unit as claimed in claim 1, wherein said conveying device (4) defines a surface (6) for conveying said stream (5) of tobacco; the intercepting branch (20) of each said suction conveyor (14) being located over, and substantially contacting, said surface (6), and lying in a plane perpendicular to the surface (6).

6. A unit as claimed in claim 5, wherein each said suction belt (32) ties in a place substantially parallel to said surface (6); the conveying branch (22) of each said suction conveyor (14) comprising a portion lying in a plane parallel to said surface (6), and extending, through said transfer station (37), in a position facing a bottom surface of a portion of the respective said suction belt (32) and at a given distance from the suction belt (32).

7. A unit as claimed in claim 5, wherein each said suction belt (32) lies in a place substantially parallel to said surface (6); the conveying branch (22) of each said suction conveyor (14) comprising a portion lying in a plane parallel to said surface (6), and extending, through said transfer station (37), in a position facing a bottom surface of a portion of the respective said suction belt (32) and at a given distance from the suction belt (32).

8. A unit as claimed in claim 7, wherein the conveying branch (22) of each said suction conveyor (14) is twisted substantially 90° into a helix extending in said given direction (11); and comprises an input portion and an output portion lying in respective planes substantially crosswise to and substantially parallel to said surface (6) respectively; said output portion being positioned facing and parallel to the respective said suction belt (32).

* * * * *